United States Patent [19]

DeBettignies

[11] Patent Number: 4,868,945

[45] Date of Patent: Sep. 26, 1989

[54] BIOMECHANICALLY ADAPTED CUSTOM FOOTWEAR

[76] Inventor: Jean DeBettignies, 3086 Foothill, Santa Barbara, Calif. 93105

[21] Appl. No.: 115,789

[22] Filed: Nov. 2, 1987

[51] Int. Cl.[4] ..... A43B 7/14

[52] U.S. Cl. ..... 12/142 N; 36/88; 128/595

[58] Field of Search ..... 12/142 N, 146 M; 36/44, 36/43, 91, 88, 93; 128/595, 584, 585

[56] References Cited

U.S. PATENT DOCUMENTS

| | | | |
|---|---|---|---|
| 2,688,760 | 9/1954 | Forte | 12/146 |
| 2,742,657 | 4/1956 | Sloane | 12/146 |
| 2,838,776 | 7/1958 | Tax | 12/142 |
| 2,907,067 | 10/1959 | Burger | 12/142 N |
| 2,955,326 | 10/1960 | Murray | 12/142 N |
| 3,782,390 | 1/1974 | Johnson | 128/595 |
| 3,825,017 | 7/1974 | Scrima | 128/595 |
| 3,848,287 | 11/1974 | Simonsen | 12/142 P |
| 3,895,405 | 7/1975 | Edwards | 12/146 M |
| 3,905,376 | 9/1978 | Johnson et al. | 128/595 |
| 3,968,577 | 7/1976 | Jackson | 36/43 |
| 3,995,002 | 11/1976 | Brown | 264/90 |
| 4,128,951 | 12/1978 | Tansill | 36/44 |
| 4,211,019 | 7/1980 | McCafferty | 36/43 |
| 4,232,457 | 11/1980 | Mosher | 36/44 |
| 4,439,934 | 4/1984 | Brown | 36/44 |
| 4,446,633 | 5/1984 | Scheinhaus et al. | 36/11.5 |
| 4,453,322 | 6/1984 | Marsh | 36/11.5 |
| 4,463,761 | 8/1984 | Pors et al. | 128/587 |
| 4,510,699 | 4/1985 | Nakamura et al. | 36/43 |
| 4,520,581 | 6/1985 | Irwin et al. | 36/93 |
| 4,550,461 | 11/1985 | Dennis et al. | 12/146 M |
| 4,563,787 | 1/1986 | Drew | 12/142 N |
| 4,597,196 | 7/1986 | Brown | 36/44 |
| 4,669,142 | 6/1987 | Meyer | 36/44 |
| 4,747,989 | 5/1988 | Peterson | 36/88 |

FOREIGN PATENT DOCUMENTS

| | | | |
|---|---|---|---|
| 2624186 | 12/1977 | Fed. Rep. of Germany | 128/595 |

OTHER PUBLICATIONS

"Therapeutic Footwear for the Insensitive Foot", George H. Hampton, MPH, "Physical Therapy", vol. 59:8–33, 1979.

"Construction of the Quickie Sandal", 12/1972.

*Primary Examiner*—Steven N. Meyers

*Attorney, Agent, or Firm*—Natan Epstein

[57] ABSTRACT

An article of footwear contoured to the foot of a wearer is constructed by first making a rough sole element. The element is made by taking a negative impression of a wearer's foot while in a non-weight bearing neutral biomechanical alignment. The edges and undersurface of the rough sole element are then contoured to form a finished sole which acts to maintain the neutral biomechanical alignment while in use.

13 Claims, 5 Drawing Sheets

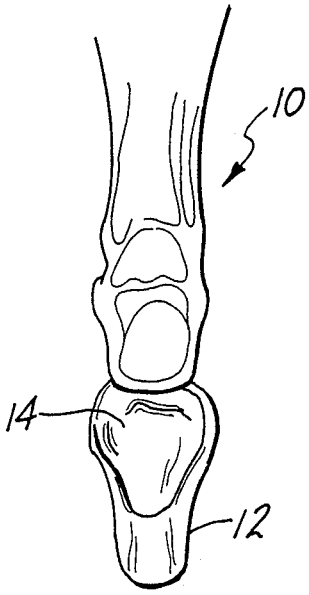
FIG. 1a
FIG. 1b
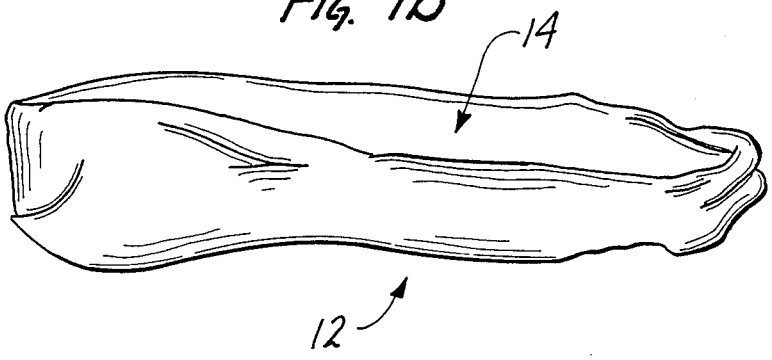
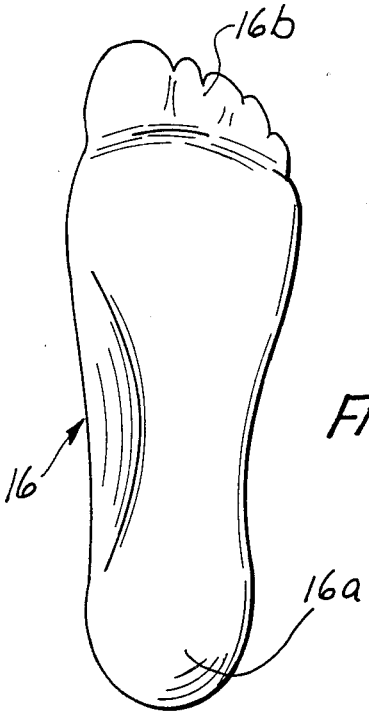
FIG. 2b
FIG. 2a
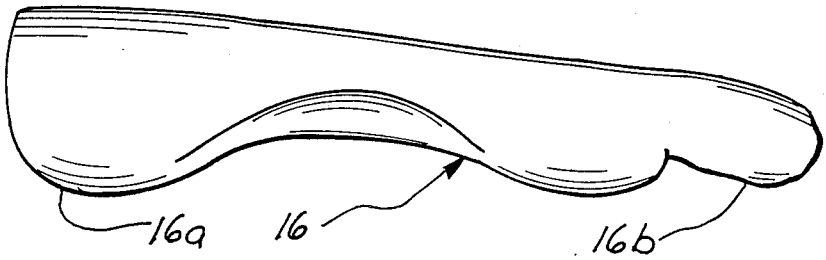

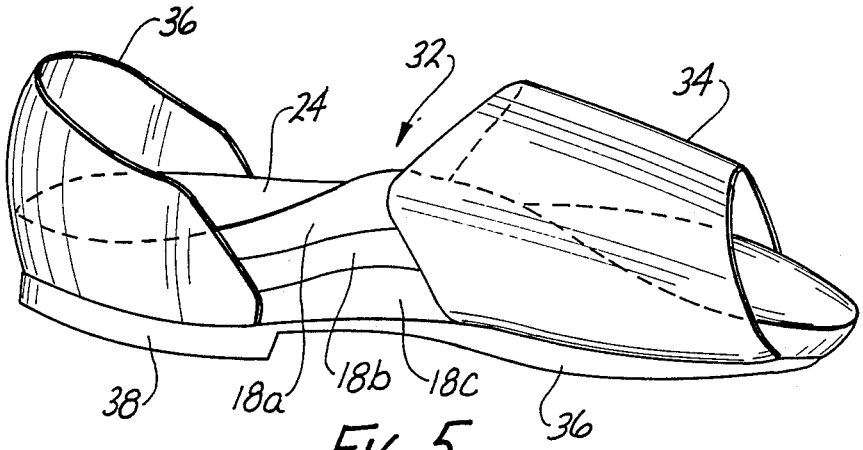
FIG. 5
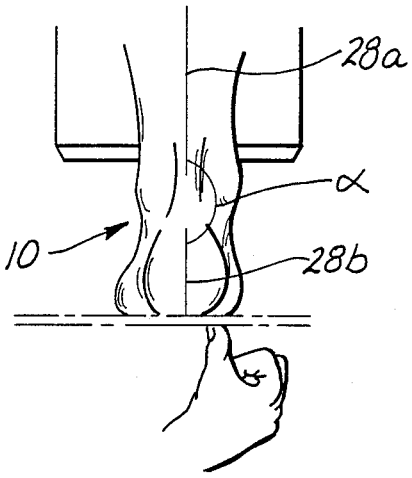
FIG. 5a
FIG. 5b
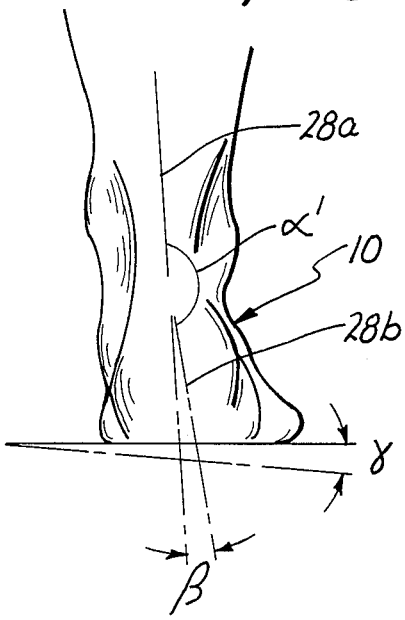
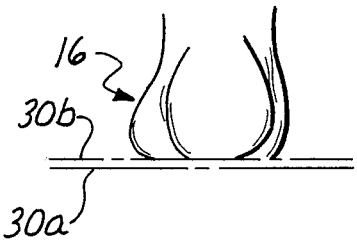
FIG. 6a
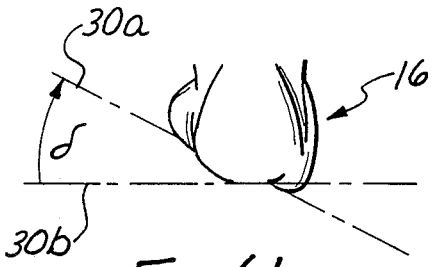
FIG. 6b

BIOMECHANICALLY ADAPTED CUSTOM FOOTWEAR

BACKGROUND OF THE INVENTION

1. FIELD OF THE INVENTION

The present invention pertains generally to the field of personal footwear and more particularly relates to the manufacture of biomechanically adapted custom footwear.

2. STATE OF THE PRIOR ART

Human locomotion involves a complex but specific sequence of movements of the foot during which the foot is subject to great pressures and stresses, even in normal standing and walking activities. The human foot comprises a large number of bones and a multitude of joints all of which must cooperate closely and in correct relationship during such activities and dysfunctionate, frequently painful anomalies of the foot anatomy are common. Orthopedic medicine, directed to prevention and correction of such anomalies, is well developed and supportive footwear has long been available for alleviating or preventing biomechanical difficulties of the foot.

The greatest number of commercially manufactured footwear is not constructed to cooperate with the normal, natural biomechanics of the foot. A small portion of commercial footwear does incorporate some biomechanical considerations in its design but mass manufacture necessitates that the footwear be fitted to some theoretically derived average foot and consequently does not address the myriad anatomical variations and peculiarities encountered between one individual and the next. Attempts at biomechanical improvements in commercial footwear have included "insoles" for cushioning and/or arch support, such as are shown for example in Mosher U.S. Pat. No. 4,232,457. Other orthopedically corrective elements incorporated into footwear are shown in Schenihaus et al. U.S. Pat. No. 4,446,633 and Marsh U.S. Pat. No. 4,453,322. Resilient removable inserts have been introduced to provide improved protection against heel strike, particularly in sport shoes. Still other cushioning elements have been devised using water, gels, and other fluids capable of conforming to and supporting the foot in the shoe. Self-injectable gels and other compounds intended to take on the shape of an individual foot and set permanently in that shape are available, particularly in connection with ski boots and the like. These devices however are accommodative in nature, rather than biomechanically adaptive, in that the shoe conforms to and fits the foot but does not produce any biomechanical improvements. These devices in any event are not very popular on the consumer market. Pre-made arch supports are also available and typically consist of pre-formed foam inserts which do improve the bio-mechanics of the shoe, but do not provide sufficient biomechanical correction for many individuals and are therefore of limited value.

A great deal of attention has been directed in recent years to biomechanical improvements in sporting and exercise footwear. Many of the techniques and approaches which have been traditionally thought of as corrective in nature have been more recently adopted by manufacturers of sporting shoes, and the use of biomechanically corrective shoes is no longer viewed as a stigma, but rather a status symbol. Such footwear, however, may also be generally categorized as adaptive footwear, i.e. footwear designed to adapt to the shape of the wearer's foot, rather than biomechanically correct supportive footwear. Various approaches have been used in constructing adaptive footwear. The sole material may be selected to have a suitable durometer rating, i.e. resilience, so as to better absorb shock. This feature may be combined with a shaped sole, such as a sole curved to the shape of some "average" foot. The biomechanics of such adaptive footwear are indeed improved and such footwear is popular and beneficial. The drawback lies in the fact that the footwear is mass produced and not sufficiently tailored to individual needs.

At the opposite extreme, orthotic inserts are available for correcting specific, individual biomechanical foot problems. Orthotic inserts are fully customized items prepared in accordance with the medical prescription of a podiatrist following examination and evaluation of the particular patient's foot bio-mechanics. These inserts are only available by prescription from an orthopedic physician, podiatrist or other medical doctor for providing lift and support to affected portions of the foot and thereby to biomechanically correct a specific diagnosed problem. Orthotic inserts are intended for use with ordinary, commercially mass produced footwear and as a rule are constructed to support only the arch and sometimes the heel of the foot. Orthotic inserts do not extend to the toes of the foot. Custom made orthotics are expensive and may not fit all types of commercially available footwear.

In spite of these and other efforts, spanning many decades, aimed at providing biomechanically correct footwear, and notwithstanding the availability of both mass produced and custom orthotic devices and footwear, there is a continuing need for footwear which is biomechanically custom fitted to the individual yet available at reasonable cost without prescription.

SUMMARY OF THE INVENTION

The novel method disclosed here departs from the generally piecemeal approach currently practiced in the manufacture of orthopedic footwear and advances the state of the art by constructing the article of footwear around a previously built-up shoe sole element which has been fully tailored and customized to the biomechanics of the intended wearer. The upper portions of the shoe are only subsequently attached to the custom shoe sole, which thus becomes a customized biomechanically correct supportive unit fully integrated with the finished shoe. The shoe sole has a top surface, an undersurface and a contour edge, each of which is custom shaped and fitted to the requirements of the intended wearer to correctly interface the foot to the ground surface.

In this method for making individually adapted biomechanically correct footwear the persons's foot is first placed in a selected biomechanical position, normally a non-load bearing or partially load bearing neutral position. A custom fitted shoe sole is then prepared by making a full sized substantially exact negative impression of the underside of the patient's foot in the selected biomechanical position with a moldable normally pliable material suitable for use as the sole of an article of footwear. The edges of the negative impression are contoured to a size and shape fitted to the particular patient's foot and the sole is finished by forming an undersurface including forefoot and rearfoot portions of the same which are individually angled as necessary to maintain the selected biomechanical position of the foot while the person is standing and the foot is therefore in a weight bearing condition. An upper is then attached to the finished sole to complete an article of footwear ready to wear. The top surface of the shoe sole is thus shaped to provide biomechanically correct lift and support while the contour of the sole is also custom sized and shaped for the particular foot of the particular individual.

More specifically, the negative impression may be made by taking a negative slipper cast of the person's foot in the selected biomechanical position, then making a positive full size mold of the slipper cast and finally applying pliable sole material in a moldable state to the positive mold to make a full size negative impression of the foot's sole. This negative impression after being allowed to set retains the topographical features of the selected biomechanical foot position. The pliable negative impression is initially rough and oversized in relation to the foot and the excess material is removed as by grinding to form the custom sized and shaped sole contour. Finally, where necessary, the sole's undersurface is formed at an angle, as will be described, in order to preserve the selected biomechanical position of the foot when the latter is in a weight bearing position on the custom shoe sole as during standing and walking. Optionally, a wear resistant layer of material may be applied to the shoe sole undersurface for extended service.

The shoes made according to this invention are customized to a degree not previously possible even with custom orthotic inserts, nor with any form of existing adaptive footwear, yet can be made available at reasonable cost. Further, these benefits are provided in a retail item as opposed to orthotic inserts available by medical prescription only.

BRIEF DESCRIPTION OF THE DRAWINGS

FIG. 1*a* is a posterior elevational view of a typical foot with the skeletal structure outlined in biomechanically neutral position, and a negative slipper cast just separated from the foot.

FIG. 1*b* is a side elevational perspective of a typical slipper cast;

FIG. 2*a* is a side elevational perspective view of a positive mold taken from the negative slipper cast of FIG. 1*b*.

FIG. 2*b* is a bottom plan view of the positive cast of FIG. 2*a*.

FIG. 5 shows a typical article of left footwear constructed by attaching a shoe upper to the custom shoe sole of FIG. 4;

FIGS. 5*a* and 5*b* illustrate the measurement of the rear foot sole angle.

FIGS. 6*a* and 6*b* illustrate the measurement of the forefoot sole angle.

DETAILED DESCRIPTION OF THE PREFERRED EMBODIMENT

Figure 3A:
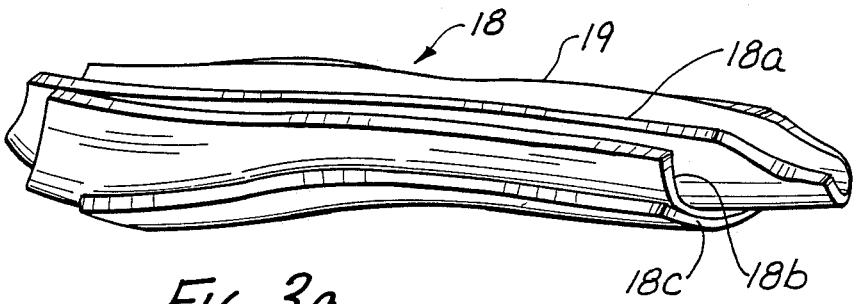
FIG. 3*a* is a perspective side view of a right foot rough negative impression obtained by application of multiple layers of thermally moldable material to the underside of the positive cast of FIG. 2*a*.

Turning now to the drawings, FIG. 1*a* shows a typical human right foot 10 in posterior elevational perspective with the major bones of the heel and ankle in outline. The foot 10 is shown in biomechanically neutral position, i.e., with the sub-talar joint being neither pronated nor supinated. The foot is positioned in this biomechanical state by feel and manipulation while the patient is typically lying either face down (prone) or lying face up (supine) by persons trained and experienced in the field of orthopedics.

With the foot in the neutral position, a full sized negative impression is taken of the entire underside or sole of the foot 10, including the heel and the toes, preferably by making a so-called "slipper" cast such as shown in FIGS. 1*a* and 1*b*. A hollow shell or "slipper" 12 interiorly coated with fluid plaster is constructed by wrapping plaster splints, plaster covered gauze strips of the type commonly used to make immobilizing casts for fractured limbs and the like. Wet plaster strips are applied over the foot 10 while the latter is kept in biomechanically neutral position until and adequate slipper structure is built up closely following the shape of the foot's underside. The slipper 12 is then separated from the foot 10 preserving a negative impression 14 of the foot sole in the interior of the slipper, which is then allowed to set and harden.

A positive casting 16 is then prepared by pouring plaster or equivalent material into the slipper 12 and allowing this material to set and harden. The "slipper" cast 12 is then broken away and discarded to expose the positive cast 16. FIGS. 2*a* and 2*b* show a typical positive cast 16 taken in this fashion, which is an accurate replica and positive duplicate of the sole of the foot 10 in biomechanically neutral position.

Figure 3B:
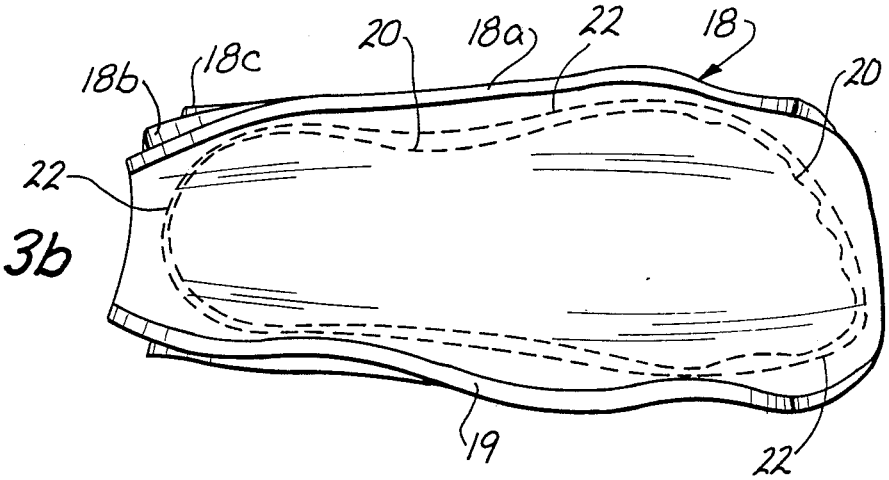
FIG. 3*b* is a top plan view of the rough negative impression of FIG. 3*a*.

The custom shoe sole is then made using a moldable material which in its normal set condition is suitable for use as the sole of an article of footwear. Desirably, this material is semi-rigid and resiliently deformable so as to yield and adapt to the changing sole shape of the foot through the gait cycle (the mechanical process involved in walking) and returns to its original shape after each step. One product found to be suitable for this purpose is commercially sold under the trade name Vulite and available from Oregon Leather, 810 Couger, Eugene, Oreg. 97402. This material is available in sheets approximately one quarter (0.25) inch thick which can be readily heated to a moldable state in a convection oven. A rough sole element 18 such as shown in FIGS. 3 is built-up in layers by first applying a roughly contoured, somewhat oversized top sheet 18*a* of heated, deformable Vulite material against the positive mold 16, and manually pressing and contouring the sheet 18*a* while still hot to the underside of the positive mold 16 until the Vulite closely conforms to the shape and curvature of the entire foot sole. The object is to create a concave basket-like rough mold with a negative impression of the foot at the bottom of the concavity, as illustrated in FIG. 3. The rough sole element 18 is then built up to a thickness suitable for a shoe sole by applying an intermediate layer 18*b* and then a bottom layer 18*c* of similarly heated, deformable Vulite sheet material which are successively pressed and shaped against the underside of the top layer 18*a*. After cooling, these three stacked layers adhere together and the exposed upper surface of the top layer 18*a* retains the impression of the foot sole 16. The foot sole element 18 has a rough unfinished edge 19 surrounding the sole imprint 20. This excess material is then removed to shape and size the sole element 18 to a custom fit for the particular foot 10 of FIG. 1. The excess material may be conveniently removed by grinding off on an abrasive grinding wheel or by any other suitable cutting or material removal method to a finished edge 22 generally contoured to the sole of the positive mold 16 and preferably allowing an excess margin of approximately ½ inch to accomodate flattening and lateral spread of the foot 10 while in a standing, weight-supporting condition.

The Vulite material is available in different grades of elasticity, hardness, and resistance to wear, and the different layers forming the rough sole element 18 may be individually selected for e.g. greater softness in the upper layer 18*a* for comfort and increasing stiffness and wear resistance in the intermediate and lower layers 18*b*, 18*c*, for good support and durability.

Figure 4A:
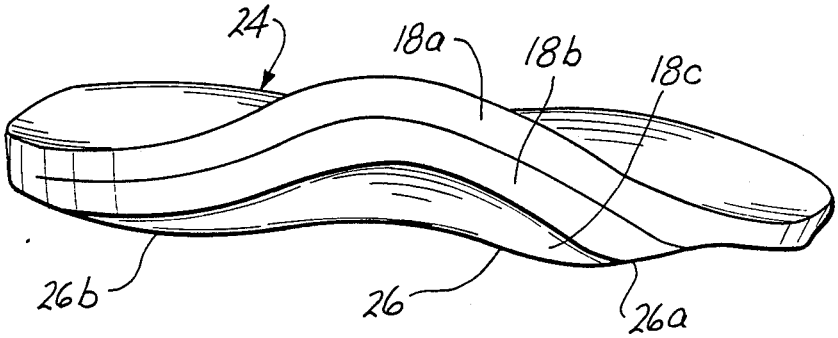
FIG. 4*a* shows in side view a custom fitted left shoe sole made by removing excess material from a rough impression as in FIG. 3.
Figure 4B:
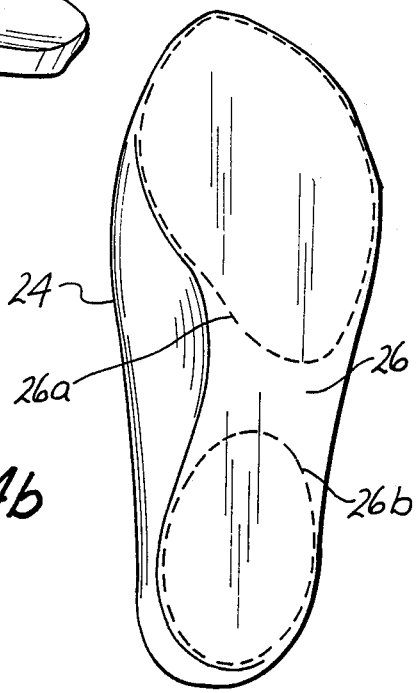
FIG. 4*b* is a bottom plan view of the shoe sole of FIG. 4*a*.
Figure 7:
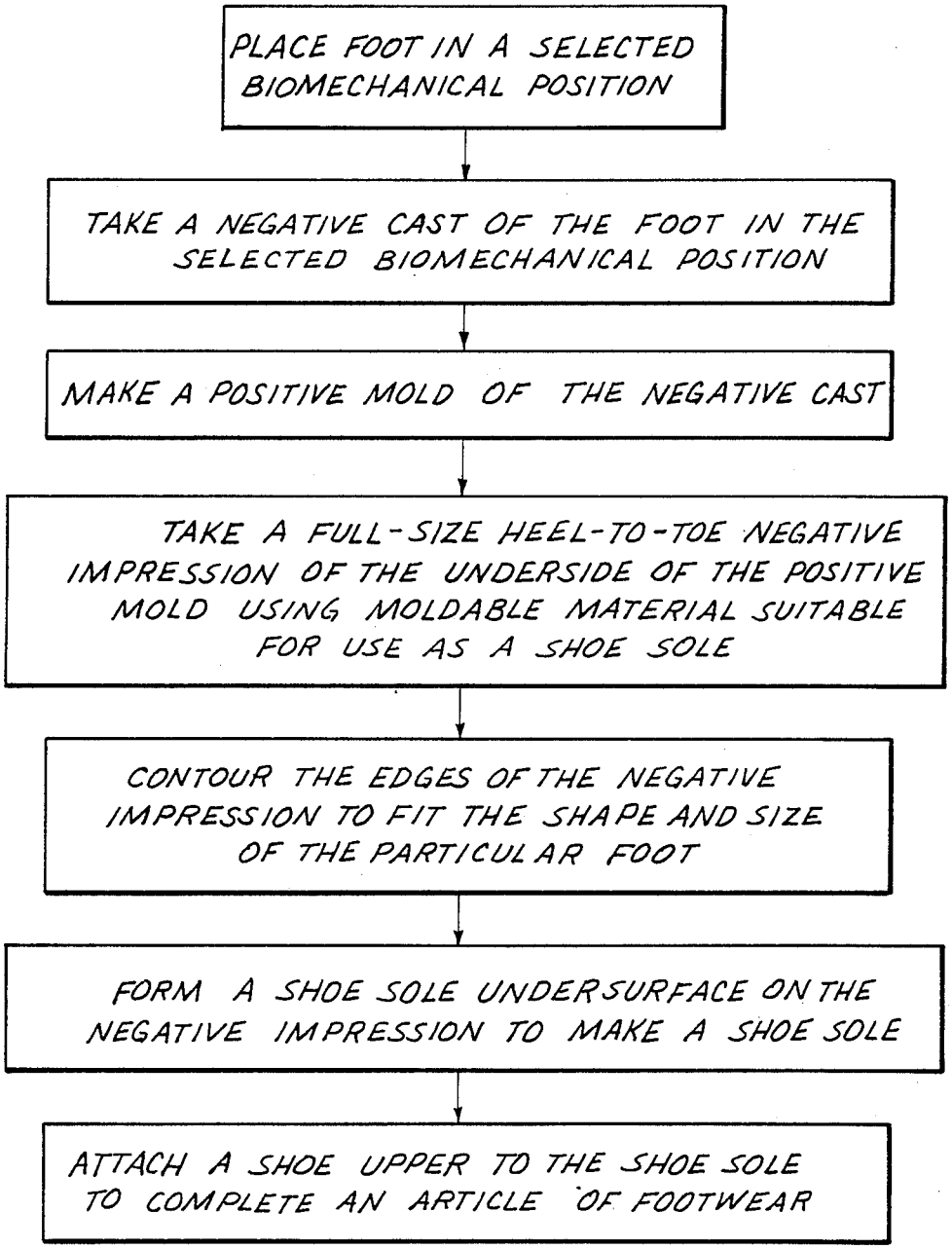
FIG. 7 is a flow chart of the method for making biomechanically fitted footwear according to this invention.
Figure 8:
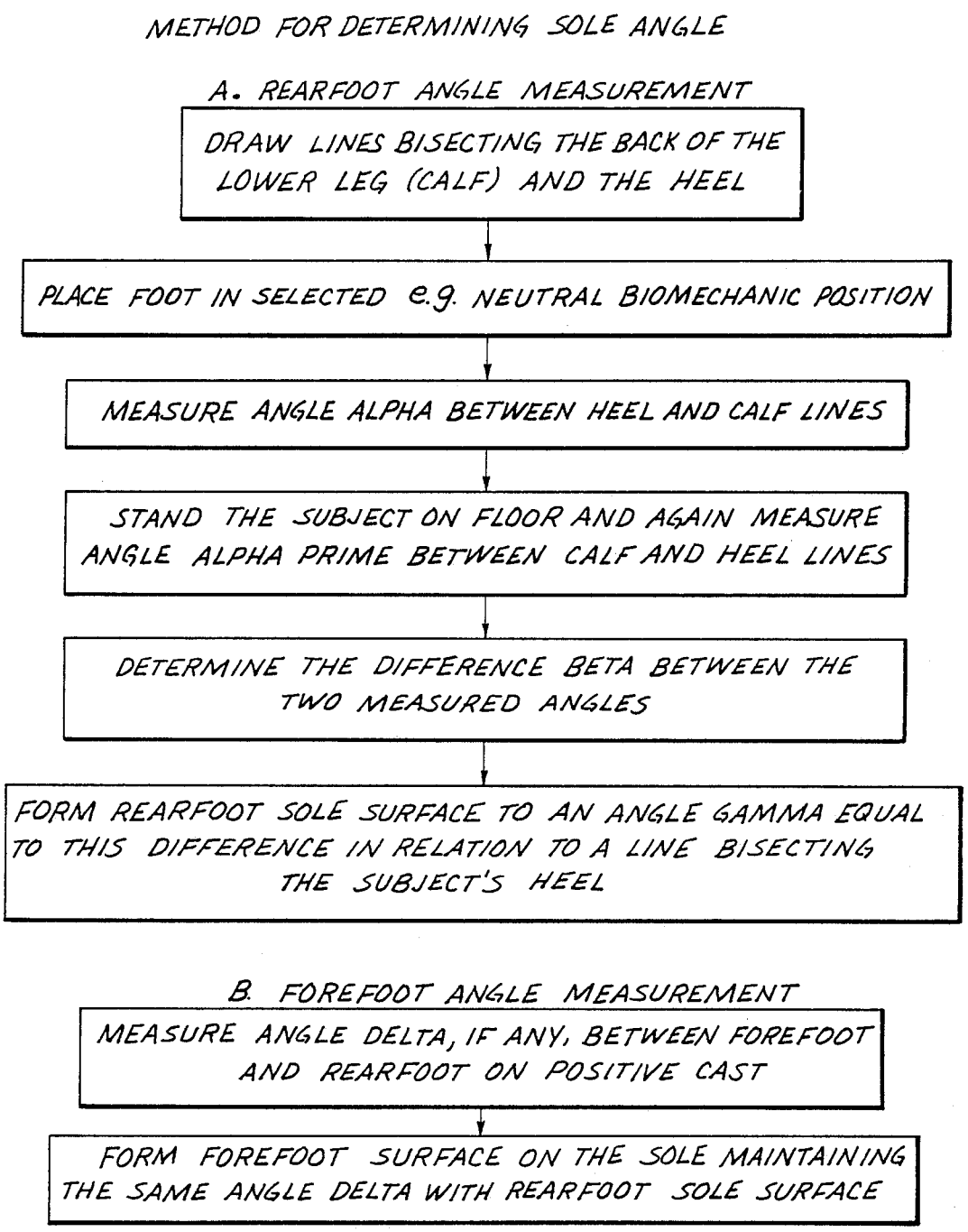
FIG. 8 is a flow chart detailing the step sequence for forming the shoe sole undersurface.

After edge contouring, the sole element 18 can be processed into a finished shoe sole 24 such as shown in FIGS. 4*a* and 4*b* by grinding off excess thickness and the irregular underside to form a generally planar ground contacting undersurface 26. The sole undersurface 26 includes a forefoot portion 26*a* and a rear foot portion 26*b* each of which can be formed to an angle adapted to the particular foot so as to preserve the biomechanically neutral position of the foot while the subject is standing on the shoe sole 24 and the foot is in a weight bearing condition. The undersurface 26 is biomechanically custom fitted by first measuring the rear foot angle as follows. The subject lies on his or her stomach on a table with the foot in a natural position and line segments 28*a* and 28*b* are drawn bisecting the back of the lower leg and heel respectively as shown in FIG. 5A. The foot 10 is then manually placed in the neutral position i.e. where the foot is neither pronated (arched too high) or supinated (arched too low). Using a protractor, the resultant angle alpha between the heel line segment 28*a* and the calf line segment 28*b* is measured with the foot in biomechanically neutral position. This angle is zero if the leg and calf line segments remain in line, but the angle may take other, non-zero values. The person is then stood on the floor and again using a protractor, a second measurement is made of the angle alpha prime between the calf and heel segments while the person is standing. The difference between the two angles (alpha minus alpha prime) measured in neutral position and in standing position, respectively, determine the angle beta (alpha prime minus zero in the example of FIGS. 5*a* and 5*b*) to which the rearfoot portion of the sole is to be ground so as to properly compensate for this difference and bring the foot into neutral position while the person is standing on the sole. The semi-finished contoured sole element 18 is then mated against the sole of the positive mold 16 and a flat rearfoot surface 20*a* is ground to the necessary angle gamma referenced against a vertical line bisecting the heel of the positive mold 16, as indicated in FIG. 5*b*.

The forefoot angle measurement is most conveniently taken from the positive cast 16 shown in FIGS. 2*a* and 2*b* in a manner illustrated in FIGS. 6*a* and 6*b*. If the forefoot portion of the positive cast is level with its rearfoot portion as suggested by parallel lines 30*a* and 30*b* in FIG. 6*a*, then the sole 24 is formed without an angle between the forefoot and rear foot portions, i.e., the forefoot and rearfoot portions are formed to the same angle gamma in relation to the heel bisecting line. If the forefoot of the positive cast is not level with the rear as indicated by intersecting lines 30*a* and 30*b* in FIG. 6*b*, then the angle delta between the forefoot and rear foot portions must be measured, and the forefoot portion 26*b* is ground on the sole at this measured angle delta between the forefoot and rearfoot portions 26*a*, 26*b* respectively so as to maintain the entire foot 10 as near as possible to its neutral position while standing on the sole 24.

The finished shoe sole 24 is then ready for incorporation into a complete article of footwear 32 as in FIG. 5 by attaching an upper shoe portion of any preferred design and construction to the custom shoe sole. In the example of FIG. 5, the shoe upper is sandal-like in two pieces and includes a forefoot strap 34 and a heel cup 36 affixed as by adhesive, stitching or other suitable means to the sole 24. More formal shoewear can be constructed by attaching a full upper portion of conventional or other design to the custom sole 24.

In FIG. 5 a bottom layer 36 of wear resistant material such as leather, plastic or other material may be attached to the sole undersurface 26 to protect the moldable material of the sole and allow for the possibility of resoling of the footwear after a period of use. If desired, a heel 38 can also be affixed to the rear portion of the shoe 32.

The entire process is of course repeated for the right foot and the left foot of the intended wearer to make a pair of shoes. Each finished shoe sole 24 is not only biomechanically correct as to both its upper and undersurfaces, but is also custom sized and shaped in its peripheral outline for the particular foot. The esthetic appearance of the finished shoe need not suffer as a result of the emphasis on biomechanical correctness. The foregoing options allow the construction of an almost unlimited range of styles and designs of footwear of either practical or fashionable design depending on the choice of upper and heel styles, configurations and combinations attached to the sole 24. In all cases however, the resulting article of footwear will be tailored to the individual needs of the person for whom it is made.

While a particular embodiment of the invention including specific materials and processes has been described and illustrated for purposes of clarity, it must be understood that the embodiment described is by way of example only and that many changes, modifications and substitutions will become apparent to those persons possessed of ordinary skill in the art without thereby departing from the spirit and scope of the present invention as defined in the following claims.

What is claimed is:

1. A method for making footwear biomechanically adapted to an intended wearer comprising the steps of:

manually positioning one foot of the intended wearer in non-weight bearing neutral biomechanical alignment;

making a unitary rough sole element having an upper sole surface in which is formed a negative impression of the underside of said one foot in said select position, said sole element being of a moldable normally pliable material suitable for use as the sole of an article of footwear;

contouring the edges of said rough sole element surrounding said negative impression to a size and shape fitted to said foot;

removing material from said rough sole element to form an undersurface including forefoot and rearfoot undersurface portions individually angled relative to said upper sole surface for maintaining said neutral biomechanical alignment in a standing position of said wearer to make a finished shoe sole; and attaching a shoe upper to said shoe sole thereby to complete an article of footwear which is both biomechanically improved and custom sized to said foot.

2. The method of claim 1 further comprising: repeating said steps of placing, making, contouring and attaching for the other foot of said intended wearer.

3. The method of claim 1 wherein said step of making a negative impression comprises the steps of:

taking a negative slipper cast of said foot in said select position;

making a positive full size mold of said slipper cast; and applying said moldable material to said positive mold to make said full size negative impression of the sole of said foot in said selected biomechanical position.

4. The method of claim 1 wherein said negative impression initially has excess thickness and rough edges, and said step of contouring comprises the step of reducing said negative impression to size, contour shape and thickness fitted to said foot and appropriate for use as a shoe sole in an article of footwear.

5. A method for making footwear biomechanically adapted to a foot of an individual comprising the steps of:

placing said foot in non-weight bearing biomechanically neutral alignment;

taking a negative slipper cast of said foot in said position;

making a positive full size heel-to-toe mold of said negative cast;

manually applying a succession of sheets of moldable material to said positive mold to build-up a sole blank bearing a full size negative impression of the foot's sole in said biomechanical alignment;

shaping the edges of said sole blank around said negative impression to make a shoe sole correctly contoured and sized for the particular foot;

removing material from said sole blank to form an undersurface on said shoe sole blank including fore foot and rear foot undersurface portions each angled relative to said negative impression so as to preserve said neutral alignment while said foot is in a weight bearing condition on said shoe sole; and attaching a shoe upper to said shoe sole thereby to obtain an integrated article of footwear which is both biomechanically correct and custom sized and contoured for the particular foot.

6. The method of claim 5 wherein said moldable material is thermomoldable and is normally semi-rigid and resiliently deformable.

7. The method of claim 6 wherein said moldable material is in sheet form and is applied in a heated moldable state to said positive mold in multiple layers to build up a three-dimensional negative impression, the built-up moldable material then being allowed to cool and set to retain the shape of said mold.

8. The method of claim 5 further comprising the step of attaching a protective layer of wear resistant material to said undersurface.

9. The method of claim 5 further comprising the step of attaching a heel to said undersurface.

10. An article of footwear comprising a unitary molded shoe sole having an upper surface substantially shaped as a negative impression of the foot sole of an intended user in a non-weight bearing biomechanically neutral position, an undersurface including forefoot and rearfoot surface portions individually angled in relation to said upper surface for maintaining the foot of said intended user in said neutral position while in a weight bearing condition on said shoe sole, a shoe sole edge contoured to a size and shape custom fitted to said foot, and shoe upper means attached to said shoe sole.

11. The article of claim 10 wherein said unitary sole is of thermomoldable material.

12. The article of claim 10 further comprising a layer of wear resistant material attached to said undersurface.

13. The article of claim 10 further comprising a heel attached to said rear foot surface.

* * * * *